United States Patent [19]

Kroeger

[11] Patent Number: 4,702,020

[45] Date of Patent: Oct. 27, 1987

[54] CURLING SLIDER

[76] Inventor: Henry Kroeger, 1372 Henderson Highway, Wpg. Man., Canada, R2G 1MB

[21] Appl. No.: 900,518

[22] Filed: Aug. 26, 1986

[51] Int. Cl.[4] ..... A43B 3/12

[52] U.S. Cl. ..... 36/11.5; 36/7.5; 36/132; 36/136

[58] Field of Search ..... 36/11.5, 7.5, 7.7, 1, 36/122, 132, 136, 7.6, 115, 73, 7.2

[56] References Cited

U.S. PATENT DOCUMENTS

| | | | |
|---|---|---|---|
| 745,442 | 12/1903 | Innes | 36/1 |
| 966,821 | 8/1910 | Gaiv | 36/1 |
| 1,160,162 | 11/1915 | Haas | 36/7.5 |
| 1,284,001 | 11/1918 | Weldon | 36/1 |
| 1,744,003 | 1/1930 | Gallagher | 36/7.2 |
| 1,866,006 | 7/1932 | Bergstrand | 36/115 |
| 2,628,437 | 2/1953 | Forsythe | 36/7.7 |
| 4,199,880 | 4/1980 | Frey | 36/132 |
| 4,525,939 | 7/1985 | McNeil et al. | 36/132 |
| 4,620,375 | 11/1986 | Wallace | 36/7.5 |

FOREIGN PATENT DOCUMENTS

| | | | |
|---|---|---|---|
| 265376 | 10/1912 | Fed. Rep. of Germany | 36/62 |
| 3004096 | 8/1980 | Fed. Rep. of Germany | 36/132 |
| 2352529 | 1/1978 | France | 36/7.5 |
| 4052 | of 1898 | United Kingdom | 36/7.2 |

*Primary Examiner*—Harvey C. Hornsby
*Assistant Examiner*—Mary A. Ellis
*Attorney, Agent, or Firm*—Stanley G. Ade; Adrian D. Battison

[57] ABSTRACT

A curling slider is formed from a rigid flat plate member of stainless steel which is hard chromed on an underside. The plate has upcurved side and front edges to avoid scoring of the ice. It is attached to a rigid plastics inner by rear side tabs which receive a flange of the inner and a front tab which is attached to a toe cap portion of the inner. A strap between side walls of the inner is hinged at both ends to the inner so that the rigid inner remains stationary while the shoe flexes. A heel portion can be inserted between the plate and inner. A gripper can be applied to the undersurface of the inner with the plate readily removable. The plate can be attached directly to the sole of a shoe by adhesive and a pin.

17 Claims, 7 Drawing Figures

CURLING SLIDER

BACKGROUND OF THE INVENTION

This invention relates to a curling slider.

Curling sliders have been manufactured in various different arrangements and from various different materials including, in recent years, teflon sheets which are directly attached to the underside of the sole of a shoe. Alternative arrangements are shown in for example U.S. Pat. No. 1,284,001 from 1918, Canadian Pat. No. 1,077,711 issued in 1980, Canadian Pat. No. 674,708 issued in 1963 and Canadian Pat. No. 969,758 issued in 1975. These patents show various devices which can be attached to the sole of a conventional shoe for use in sliding on the ice in the conventional curling action.

None of these patents or arrangements have, however, provided the ideal solution for a device and sliding material which is hard wearing and hence long lasting, designed for effective attachment to the foot of the wearer, and also provides an effective sliding surface.

Various attempts have been made to design a slider from a metal material and for example the above U.S. Pat. No. 1,284,001 shows a flexible metal sheet which is attached under the sole of the shoe of the wearer by various strap arrangements. However such an arrangement has not met with with any commercial success. The specific details of the metal material are not set out in the patent and also the method of attachment of the metal sheet to the shoe is very crude and ineffective.

SUMMARY OF THE INVENTION

It is a first object of the present invention, therefore, to provide an improved curling slider which is manufactured from a material which is hard wearing and provides an effective sliding action without danger of scoring the ice surface.

According to a first aspect of the invention, therefore, there is provided a curling slider comprising a plate formed from stainless steel which is of a thickness to remain rigid against flexing forces applied by the foot of the wearer and is shaped to underlie at least a front portion of a wearer's foot and to have an upcurved edge around the periphery thereof at least at front and sides thereof so as to allow sliding on ice without scoring the ice, said stainless steel plate being hard chromed on at least an under surface thereof.

A second object of the invention is to provide an improved construction of slider which enables effective attachment of the slider to the curler's shoe.

According to a second aspect of the invention, therefore, there is provided a curling slider for attachment to a shoe of a wearer comprising a rigid plastics inner liner, said liner having a lower substantially planar wall for underlying at least a front of the sole portion of a shoe of a wearer, upstanding side wall means around at least the toe and side portions of the periphery of the wall, means attached to an underside of the planar wall defining a sliding surface for acting as a slider on the ice, said rigid inner liner including an upturned toe cap portion for extending over a toe of the shoe of the wearer so as to retain the liner on the shoe, a flexible strap member for extending around a heel of the shoe and hinge means for connecting each end of the strap to said side wall means at a respective side portion thereof to allow pivotal movement of the strap relative to the side wall means about an axis at right angles thereto.

In a preferred arrangement the metal plate can be slipped onto the inner liner so that tabs on the metal plate parallel to the plate engage around the flange at a rear end of the liner and a front tab of the plate extends upwardly to engage the liner either by releasable coupling for example a flexible loop or by a semi-permanent coupling provided by a screw.

Preferably the stainless steel plate includes a bend transverse to the central axis thereof at the rear edge thereof so as to assist in maintaining the plate flat in the area to engage the ice. A front edge may also include a slight upward incline so as again to assist in maintaining the plate flat.

The hinged coupling between the strap and the side walls of the liner enables the liner to remain fixed and flat against the sole of the shoe while the heel of the shoe can flex upwardly in a curling action. The toe cap which curves upwardly and over the toe holds the front edge of the liner in place.

A wedge member may be positioned on inner edge of one side wall of the liner so as to project into engagement with the inside of the wearer's shoe depending upon which foot the slider is to accommodate.

A third object of the invention is to provid an improved technique for attachment of the stainless steel plate to the shoe sole.

According to a third aspect of the invention therefore there is provided a curling slider for attachment to a shoe of a wearer, the slider comprising a base member formed of a rigid plastics material and shaped to cover at least part of the sole of the shoe, means for attaching the base member to the sole, and a plate member arranged for attachment to an under surface of the base member to act as a sliding surface on ice, said plate member being formed from stainless steel which is hard chromed on at least the under surface thereof.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
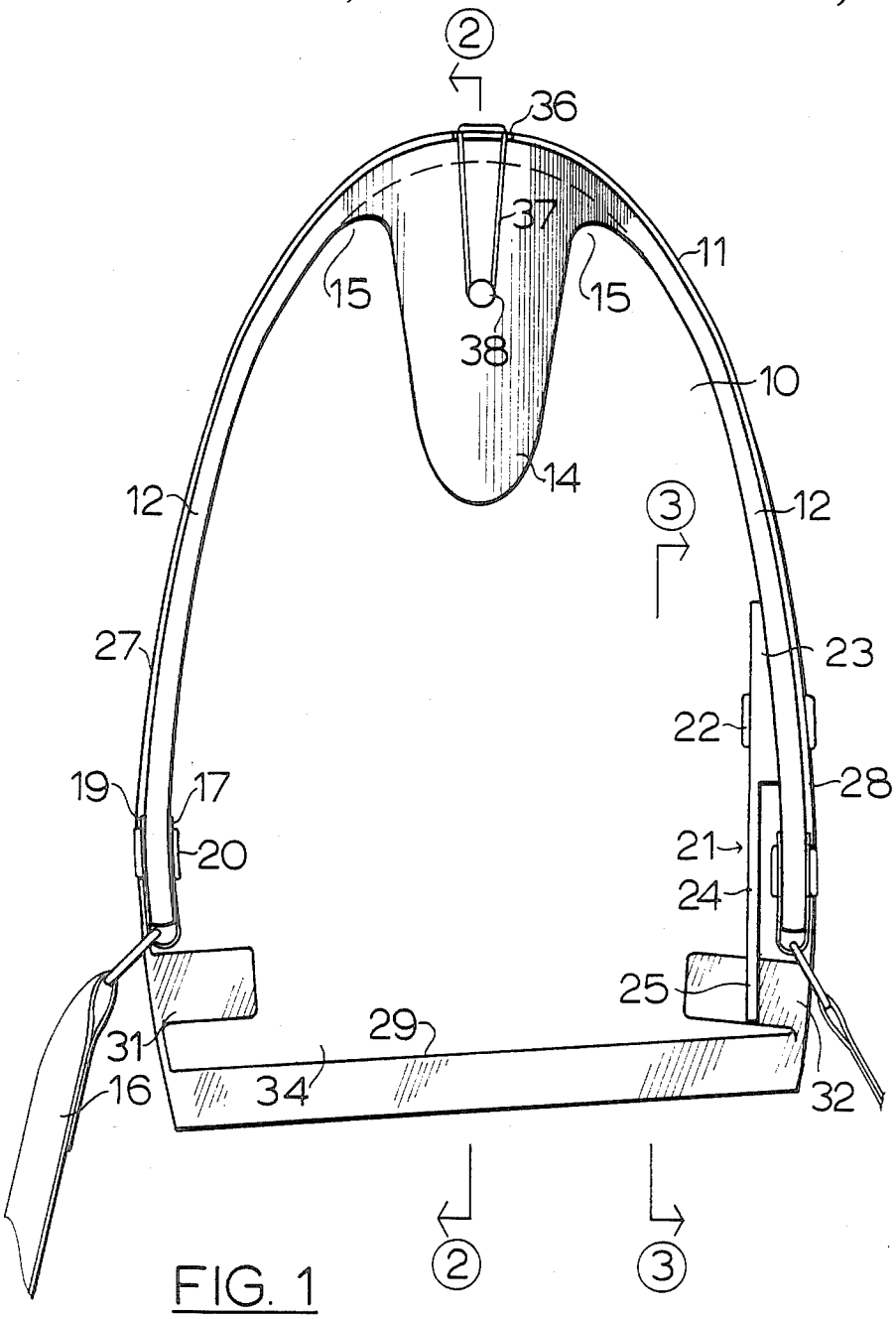
FIG. 1 is a plan view of a curling slider according to the invention.
Figure 2:
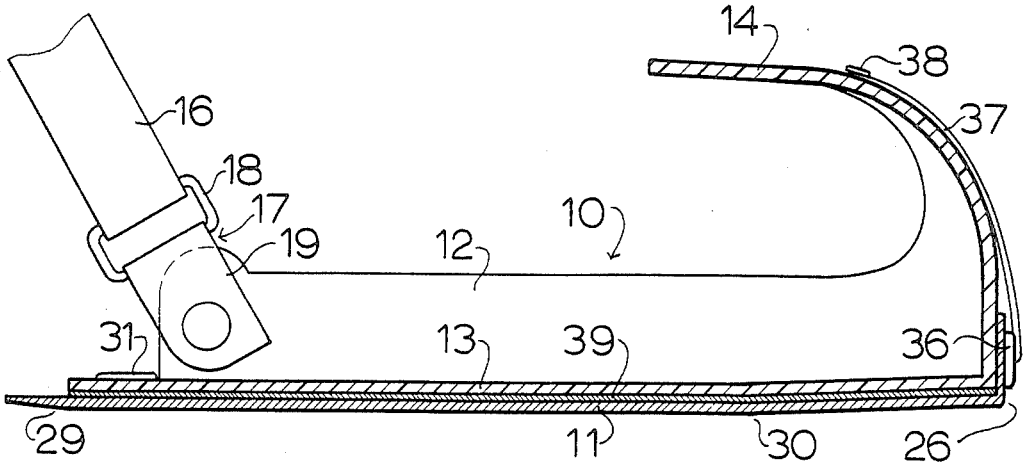
FIG. 2 is a cross sectional view along the lines 2—2 of FIG. 1.

Turning firstly to FIGS. 1 and 2, a slider comprises an inner liner 10 and a covering metal plate 11. The inner liner 10 is formed from a rigid plastics materials so as to form a surrounding side wall 12 and a substantially flat lower wall 13 upon which the shoe of a wearer can be placed.

The inner liner 10 is molded from a thermoplastic plastics material and includes a toe cap portion 14 which extends upwardly from the front end and over the toe of the shoe of the wearer so as to restrain the front end of the inner liner for moving downwardly relative to the toe as the foot of the wearer is flexed in use. The position of the upwardly turned toe cap 14 can be adjusted simply by heating the thermoplastic material in hot water and deforming the material while heated to the required position. The toe cap 14 extends, as best seen in FIG. 1, only over a part of the width of the shoe in a central prong leaving two open areas 15 on either side of the prong at which the prong joins the side wall 12.

The side wall 12 surrounds the front edge and sides of the lower wall 13 so as to confine the shoe of the wearer into the area therewithin.

A strap 16 extends across the open rear of the inner liner so as to wrap, in use, around the heel of the shoe of the wearer to retain the inner liner in place on the shoe despite flexing of the shoe about the ball of the foot. The strap 16 is attached to each of the side walls 12 by a hinge coupling 17 in the form of a loop 18 which receives the end of the strap and which is attached to a bifurcated metal piece 19 which straddles the side wall 12 and is attached thereto by a transverse pin 20. Thus each of the ends of the strap is hinged for pivotal movement about an axis at right angles to the respective side wall so that, as the heel of the wearer's shoe lifts in a flexing movement, the strap can follow this lifting movement while the inner remains firmly in place under the sole portion of the shoe.

A wedge member 21 is attached to one side wall 12 of the inner. The wedge member 21 is attached by way of a screw coupling 22 and is shown in elevational view in FIG. 3. The wedge member 21 includes a first portion having a surface 23 lying immediately adjacent the side wall 12 so as to retain the wedge member properly in position at the side wall with an inner face 24 of the wedge member projecting inwardly and rearwardly relative to the side wall 12. The inner surface 24 extends into a projecting portion 25 which terminates adjacent the rear edge of the inner liner 10 which, of course is at a position inwardly of the side wall 12. The wedge member 21, therefore, acts to cooperate with an inner surface of the shoe of the wearer so that the example illustrated in FIG. 1 acts as a slider for the left foot of a wearer with the wedge member 21 engaging the inner surface of the left foot. For those persons who perfer to wear the slider on the right foot, the wedge member 21 can be positioned on the opposed side with the screw coupling 22 passing through a suitable opening (not shown).

It will be appreciated, therefore, that the base wall 13 and the side wall 12 is effectively symmetrical and can accommodate either foot of the wearer with the tailoring of the curling slider to the required foot being obtained by the removable wedge member 21.

The plate member 11 is formed from stainless steel in 16 to 22 gauge and includes an upwardly curved edge at a front portion 26 and along sides 27, 28. The upwardly curved edge provides a radius of the order of ⅜th inch and has a height of the order of ⅛th inch merely to take away the sharp terminating edge so that it is lifted away from the ice surface to avoid any possibility of scoring of the ice surface.

In order to maintain the undersurface of the plate member 11 flat, a bend across the full width of the plate member is provided at 29 adjacent a rear edge of the plate member and in addition a slight curvature is provided at 30 on the underside toward the front edge of the plate member. This provides a flat area under the ball of the foot of the wearer which is resistent to deformation or curvature for example in the concave direction due to the rigidity of the metal used and due to the positioning of the bends forwardly and rearwardly of this area. In addition the upturned side edges which extend along the full periphery of the plate member also provide it with further rigidity so that it does not flex and remains flat even under the full weight of the wearer when applied onto the slider in a curling action.

The stainless steel plate member is formed to shape by a stamping action and is then subsequently hard chromed in a separate process on the underside to provide a surface of the plate member which is sufficiently resistant to scoring from the ice that it remains smooth and effectively frictionless relative to the ice.

Hard chroming is a conventional process and need not be described in detail, but in this situation provides a curling slider of a new unexpectedly successful material which provides the right attachment and sliding characteristics.

The plate member is shaped to exactly receive on its upper surface the underside of the rigid inner liner. It is attached to the rigid inner liner by a pair of tabs 31 and 32 at the side edges adjacent the rear edge, the tabs being turned from the upper most extremity of the curved side edge as indicated at 33 in FIG. 3 to lie parallel to the flat plane of the plate. Thus the tabs and the plate trap between them a rearwardly extending flange portion 34 constituted by an extension of the lower wall 13 of the rigid inner liner. The flange 34 can therefore be slid into place underneath the tabs 31 and 32 and is held there against vertical movement. A front edge of the plate member includes a further tab 36 turned upwardly around a front edge of the rigid inner liner and extending upwardly from the edge 33.

In FIGS. 1 and 2, the tab 36 is attached to the rigid inner liner by way of a readily releaseable coupling one example of which is shown as a flexible spring 37 which attaches over a peg 38 provided on the toe cup 14 of the rigid inner liner. In this way the wearer can simply and rapidly remove the plate member from the rigid inner liner by releasing the spring 37 from the peg 38 and then sliding the plate member rearwardly so that the flange 34 is released from the tabs 31 and 32. The plate member can of course be replaced simply by reversing this process. This conveniently enables the undersurface of the rigid inner liner to receive a gripper layer indicated at 39 in FIG. 2. In this way the same inner liner can be used as a gripper when required or as a slider merely by attaching the plate member 11.

Figure 4:
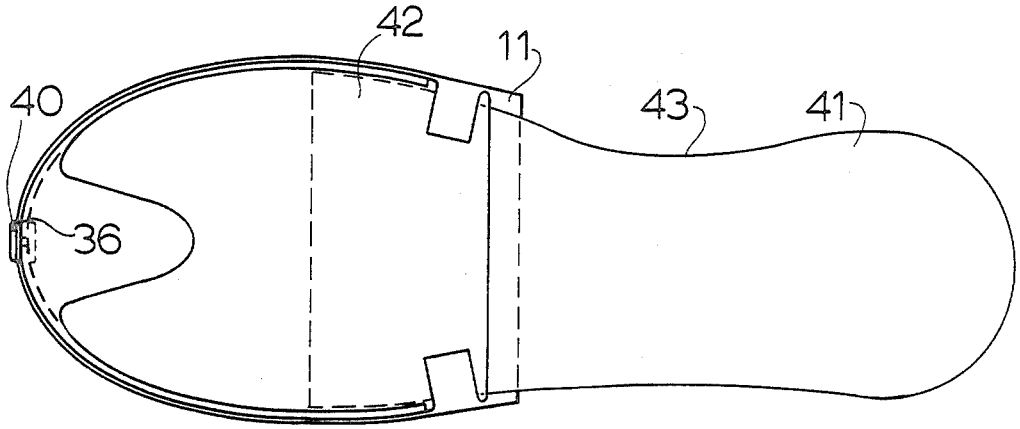
FIG. 4 is a plan view of the curling slider of FIG. 3 which some of the parts omitted for simplicity of illustration.

In FIG. 4 a more permanent attachment of the tab 36 to the rigid inner liner 10 is provided by a screw coupling 40.

Figure 3:
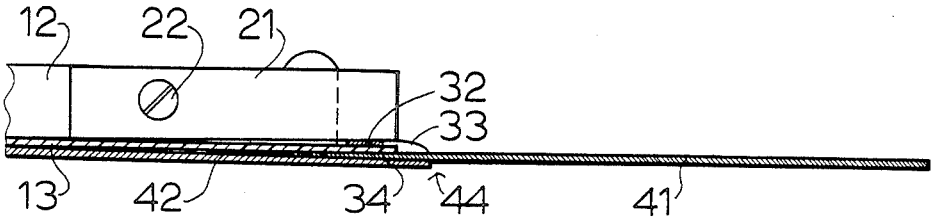
FIG. 3 is a cross sectional view nominally along the lines 3—3 of FIG. 1 but showing a modified arrangement.

The embodiment of FIGS. 3 and 4 is also modified in that the gripper layer 39 is omitted since it is intended that the plate member 11 remain permanently attached to the rigid inner liner. In this embodiment a heel portion 41 is provided which is shaped so as to cooperate with the plate member 11 to define a foot shape. The heel portion 41 is attached to the slider by an overlapping section 42 which is inserted, as best shown in FIG. 3, between the plate member 11 and the lower wall 13 of the inner so as to be held there in a friction fit or by release of an adhesive if it is intended to be retained there permanently in a fixed orientation.

It will be noted that the heel portion 41 is asymmetrical, that is it includes a curved inner side 43 which corresponds to the greater curvature on the inner side of the wearer's foot. The heel portion 41 is again formed from stainless steel but in this case is simply a flat sheet without curved up side edges in view of the fact that it acts generally to trail the plate member 11 and therefore there is little tendency for edges to score the ice surface. In this embodiment the upwardly turned rear edge of the plate member 11 is also omitted so that the plate member 11 and the heel portion 41 join at a line indicated at 44 which is effectively contiguous. The stainless steel heel portion 41 is hard chromed on both sides so that a single heel portion can be used either on the left or right slider depending upon the requirements of the user and simply by inverting the heel portion so that the curved inner side 43 is positioned on the required side.

Figure 5:
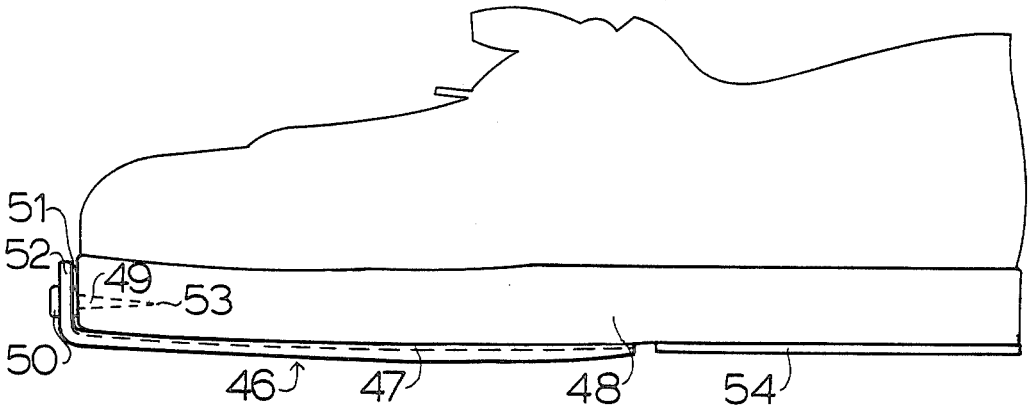
FIG. 5 is a side elevational view of a further embodiment of a curling slider.

In FIG. 5 there is shown a further embodiment in which the rigid inner is omitted and the plate member indicated at 46 is simply attached to the underside of the sole of a suitable shoe. The plate member 46 is of the same construction as the plate member 11 except that the tabs 31, 32 are omitted. In this case the plate member is shaped to match closely the size of the shoe sole so that the curved up side edges 47 of the plate member 46 wrap around the outer side of the sole. The plate member 46 is then attached to the sole by a suitable adhesive. As the plate member 46 is rigid, it does not flex with the shoe so that the shoe can bend only about a central area indicated at 48 behind the plate member 46. To resist any tendency of such flexing to remove the front edge of the shoe from the plate member, a pin 49 is screwed into the front edge of the shoe so as to extend into the body of the shoe sole. The pin 49 has a head 50 and cooperates with a nut 51 attached to the tab 52 of the plate member so that as the pin 50 is screwed into the nut, a sharp end 53 extends into the sole.

A heel portion 54 separate from the plate member can be attached to the shoe by adhesive leaving a slight space between the heel portion and the plate member to accommodate flexing of the shoe during the curling action.

Figure 6:
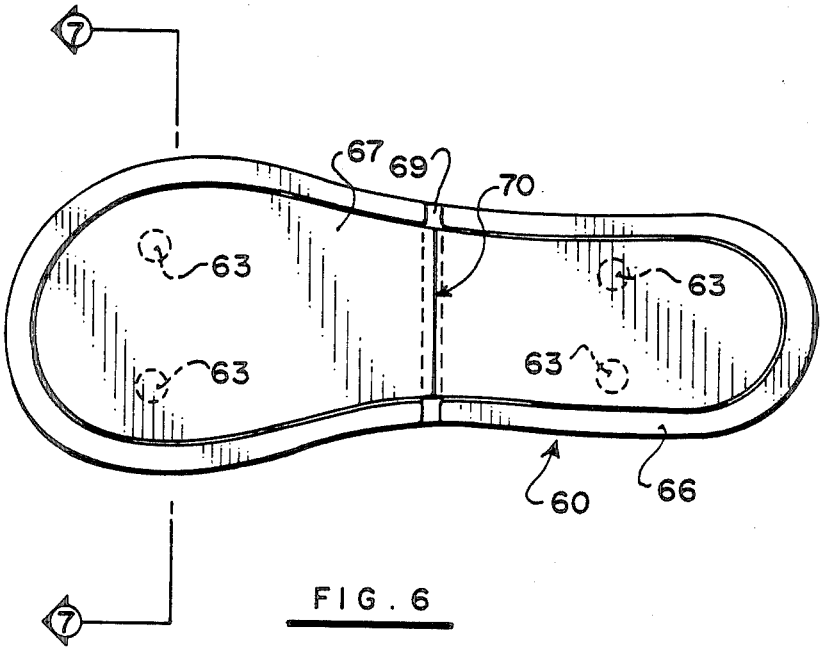
FIG. 6 is an underside view of a shoe including a yet further embodiment of the invention.
Figure 7:
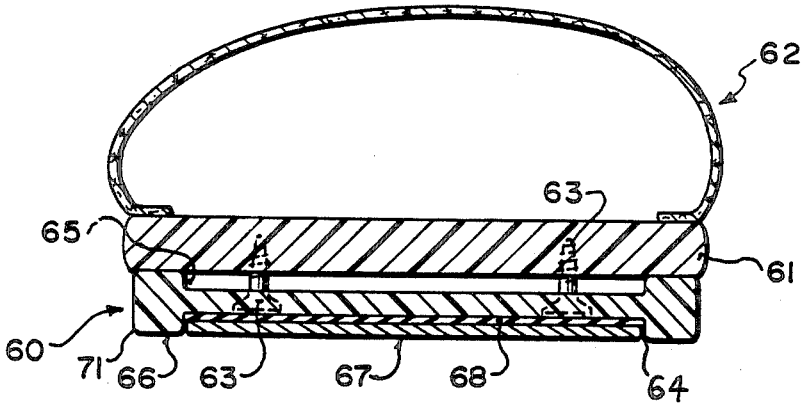
FIG. 7 is a cross-sectional view along the lines 7—7 of FIG. 6.

Turning now to FIGS. 6 and 7 there is shown a yet further embodiment which comprises a base member 60 which is basically a flat plate and can be attached to a sole 61 of a shoe 62 by screws 63. The flat plate is recessed on an under side as indicated at 64 and on an upper side as indicated at 65 to provide a central recessed area leaving an upstanding rib portion 66 around the periphery of the base member. The central recessed area 64 on the under side has mounted therein a flat plate member 67 of stainless steel of the type previously described. The stainless steel plate 67 can be attached to the base member 60 by a double sided tape schematically indicated at 68 so as to remain permanently attached within the recess 64.

As shown in FIG. 6, the base member 60 is asymmetrical so as to follow the shape of a right or left foot depending upon which side is exposed. Thus it will be appreciated that one of the recesses 64 or 65 can be exposed as required thus enabling the single base member 60 to act for either a left or right foot whereupon the plate member 67 can itself be inverted and inserted into the respective one of the recesses 64 or 65.

The base member 60 is hinged as schematically indicated at 69 to enable the plate member to flex with the shoe of the wearer across a transverse line to facilitate walking. To accommodate the hinge 69, the plate member 67 can be divided into two portions at a dividing line 70 at the hinge.

The rib 66 around the outer edge of the stainless steel plate can be rounded at the outer most edges as indicated at 71 to prevent scoring of the ice should the shoe of the wearer tip to one side. The rib 66 thus acts to protect the ice from the edge of the stainless steel plate which is safely received within the recess inside the rib 66. This avoids the necessity for any bending or the edges of the plate 67 which can therefore merely be a flat plate cut from stainless steel and hard ground on both sides.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A curling slider comprising a plate formed from stainless steel which is of a thickness to remain rigid against flexing forces applied by the foot of the wearer's foot and to have an upcurved edge around the periphery thereof at least at front and sides thereof so as to allow sliding on ice without scoring the ice, said stainless steel plate being hard chromed on at least an under surface thereof and a rigid plastics inner liner having a substantially planar wall for underlying at least a front sole portion of a shoe of a wearer, an upstanding side wall means around at least the toe and side portions of the periphery of the wall and means for attaching said liner to a shoe of the wearer, said plate including means for attachment thereof to said liner at an underside of the planar wall, wherein said plate is separable from said liner.

2. The invention according to claim 1 wherein the plate includes an upward bend along a line transverse to the foot of the wearer.

3. The invention according to claim 1 wherein said plate extends only over a front portion of the wearer's foot and includes a first bend upward along a line transverse to the foot adjacent a rear edge of the plate and a second upward bend transverse to the foot of the wearer adjacent the toe.

4. The invention according to claim 1 wherein the plate includes at least one upstanding tab by which it can be attached to a support.

5. The invention according to claim 1 wherein said liner includes an end of said lower wall extending beyond said sidewall means so as to define a flange and wherein said plate includes a pair of tabs turned to lie parallel to the plate such that the flange is trapped between said tabs and said plate to maintain said plate in position on said liner.

6. The invention according to claim 5 including means for releasably attaching said plate to said liner at a front end thereof.

7. The invention according to claim 1 including a heel portion comprising a plate member shaped to underly a heel of the shoe and to be insertable between said plate member and said liner so as to be retained therebetween to project therefrom beneath the heel.

8. The invention according to claim 7 wherein said heel portion is formed from stainless steel hard chromed on both sides thereof and asymmetrical about a longitudinal axis whereby said heel portion can accommodate both left and right shoes.

9. The invention according to claim 1 wherein said means for attachment of said liner to said shoe comprises an upturned toe cap portion of said liner for extending over a toe of the shoe of the wearer so as to retain the liner on the toe, a flexible strap member for extending around a heel of the shoe and hinge means for connecting each end of the strap to said side wall means and a respective side portion to allow pivotal movement of the strap relative to the side wall means about an axis at right angles to the side wall means.

10. The invention according to claim 9 wherein said plastics inner liner is formed from a thermoplastic material whereby said toe cap is deformable by the application thereto of heat.

11. A curling slider comprising a plate formed from a stainless steel which is of a thickness to remain rigid against flexing forces applied by the foot of the wearer and is shaped to underly at least a front portion of a wearer's foot and to have an upcurved edge around the periphery thereof at least at front and sides thereof so as to allow sliding on ice without scoring the ice, said stainless steel plate being hard chromed on at least an under surface thereof and a rigid plastics in the liner having a lower substantially planar wall for underlying at least a front sole portion of a shoe of a wearer, an upstanding side wall means around at least the toe and side portions of the periphery of the wall and means for attaching said liner to a shoe of the wearer, said plate including means for attachment thereof to said liner at an underside of the planar wall wherein said liner includes, along one side portion of said side wall means, a wedge member having an inner surface projecting rearwardly and inwardly from said side wall means and along side said side wall means for engagement with an inner face of a shoe of the wearer.

12. A curling slider for attachment to a shoe of a wearer comprising a rigid plastics inner liner, said liner having a lower substantially planar wall for underlying at least a front of the sole portion of a shoe of a wearer, upstanding side wall means around at least the toe and side portions of the periphery of the wall, means attached to an underside of the planar wall defining a sliding surface for acting as a slider on the ice, said rigid inner liner including an upturned toe cap portion for extending over a toe of the shoe of the wearer so as to retain the liner on the shoe, a flexible strap member for extending around a heel of the shoe and hinge means for connecting each end of the strap to said side wall means at a respective side portion thereof to allow pivotal movement of the strap relative to the side wall means about an axis at right angles thereto and a plate seperable from said rigid inner liner.

13. The invention according to claim 12 wherein said liner includes an end of said lower wall extending beyond said sidewall means so as to define a flange and wherein said plate includes a pair of tabs turned to lie parallel to the plate such that the flange is trapped between said tabs and said plate to maintain said plate in position on said liner.

14. The invention according to claim 12 including means for releasably attaching said plate to said liner at a front end thereof.

15. The invention according to claim 12 including a heel comprising a plate member shaped to underly a heel of the shoe and to be insertable between said plate member and said liner so as to be retained therebetween to project therefrom beneath the heel portion.

16. The invention according to claim 12 wherein said plastics inner liner is formed from a thermoplastic material whereby said toe cap is deformable by the application thereto of heat.

17. The invention according to claim 12 wherein said liner includes along one side portion of said side wall means, a wedge member having an inner surface projecting rearwardly and inwardly from said side wall means and along side said side wall means for engagement with an inner face of a shoe of the wearer.

* * * * *